US011772921B2

(12) United States Patent
Koloditsky et al.

(10) Patent No.: US 11,772,921 B2
(45) Date of Patent: Oct. 3, 2023

(54) PRINTING SYSTEM COMPRISING A TRANSPORT APPARATUS ENGAGED WITH A TRACK AND METHOD OF PRINTING

(71) Applicant: HP INDIGO B.V., Amstelveen (NL)

(72) Inventors: Yechiam Koloditsky, Ness Ziona (IL); Ilan Meiri, Ness Ziona (IL); Avihay Menashe, Ness Ziona (IL)

(73) Assignee: HP INDIGO B.V., Amstelveen (NL)

( * ) Notice: Subject to any disclaimer, the term of this patent is extended or adjusted under 35 U.S.C. 154(b) by 742 days.

(21) Appl. No.: 16/628,779

(22) PCT Filed: Jul. 28, 2017

(86) PCT No.: PCT/EP2017/069248
§ 371 (c)(1),
(2) Date: Jan. 6, 2020

(87) PCT Pub. No.: WO2019/020203
PCT Pub. Date: Jan. 31, 2019

(65) Prior Publication Data

US 2020/0122938 A1 Apr. 23, 2020

(51) Int. Cl.
*B65H 5/08* (2006.01)
*B65H 29/02* (2006.01)

(52) U.S. Cl.
CPC ..... *B65H 5/08* (2013.01); *B65H 29/02* (2013.01)

(58) Field of Classification Search
CPC ..... B65H 29/02; B65H 5/08; G03G 21/00
See application file for complete search history.

(56) References Cited

U.S. PATENT DOCUMENTS

| | | | | |
|---|---|---|---|---|
| 4,120,244 | A * | 10/1978 | Wirz | B41F 21/106 101/409 |
| 4,558,944 | A * | 12/1985 | Bothner | G03G 15/266 399/92 |
| 5,431,386 | A | 7/1995 | Blaser | |
| 5,765,081 | A | 6/1998 | Bogaert et al. | |
| 6,069,704 | A | 5/2000 | Verhaag | |
| 6,447,182 | B2 | 9/2002 | Brewington et al. | |
| 6,691,997 | B2 * | 2/2004 | Chiari | B65H 29/044 271/3.04 |
| 9,102,172 | B2 | 8/2015 | Jensen et al. | |
| 9,505,208 | B2 | 11/2016 | Shmaiser et al. | |
| 2015/0344249 | A1 | 12/2015 | Inoue et al. | |

FOREIGN PATENT DOCUMENTS

| | | |
|---|---|---|
| DE | 101131165 | * 10/2001 |
| DE | 102008051094 A1 | 4/2010 |
| JP | 2004075300 | 3/2004 |

* cited by examiner

*Primary Examiner* — Thomas A Morrison

(57) ABSTRACT

A printing system comprises a print station and print medium transport system. The print medium transport system comprises a track and a transport apparatus engaged with the track. The track defines a transport path past the print station, the transport path has a print medium entry point and a print medium exit point. The transport apparatus comprises: a drive for moving the transport apparatus along the track; and a gripping system. The gripping system can be moved between a first position in which a sheet of print medium is gripped and a second position in which the sheet of print medium is released. In use, the gripping system is configured to be in the first position when the transport apparatus is in motion along the track from the print medium entry point to the print medium exit point.

14 Claims, 8 Drawing Sheets

PRINTING SYSTEM COMPRISING A TRANSPORT APPARATUS ENGAGED WITH A TRACK AND METHOD OF PRINTING

BACKGROUND

Printing systems may use a transport system to move a print medium through the printing system and past a printing station. Sheets of print medium can be moved through a printing system using a plurality of rollers. A sheet of print medium is engaged by a roller and driven through part of the printing system by rotating the roller. As the print medium travels through the printing system, from one part to another, it is transferred from being driven by one roller to being driven by another roller.

Printing systems can be arranged to print on both sides of a print medium automatically. Such printing systems can have a print medium transport system in which a print medium is driven past a print engine one way, being passed from one roller to another. The print medium is then inverted for printing on the other side and driven back past the print medium the other way, being passed from one roller to another.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1:
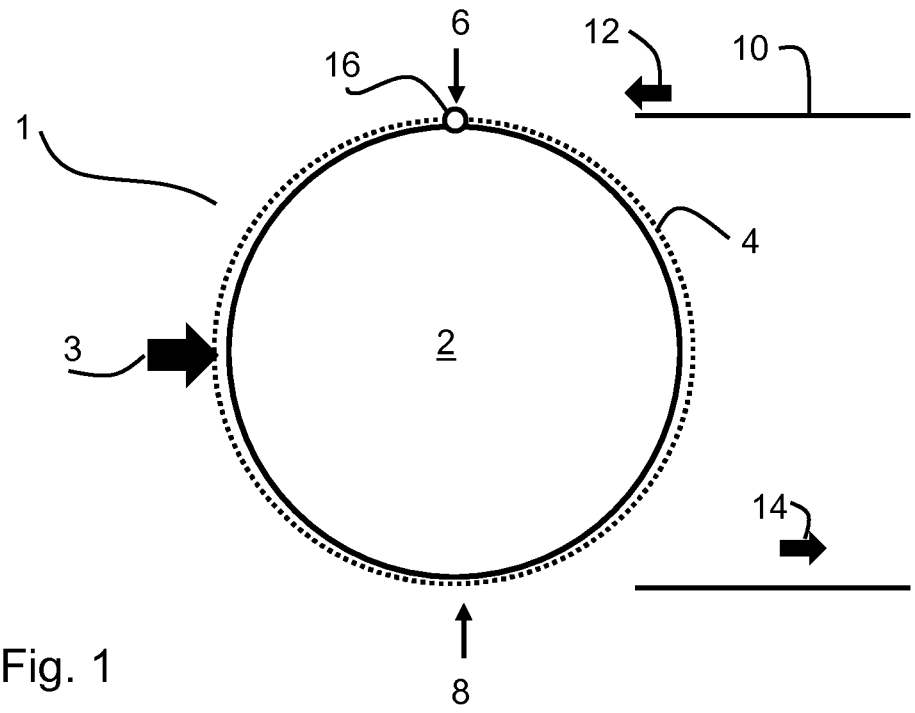
FIG. 1 is a diagrammatic representation of a printing system according to an example.

FIG. 1 shows a diagrammatic representation of a printing system 1 according to an example. The printing system comprises a print station 2. A print medium transport system a track which defines a transport path 4 past the print station 2. A print medium entry point 6 and a print medium exit point 8 are present on the transport path. A sheet of print medium 10 enters into the printing system at the print medium entry point 6 in the direction indicated by arrow 12 and exits the printing system at the print medium exit point 8 in the direction indicated by arrow 14.

A print medium may also be referred to a print target. Print medium will be used hereafter. Any suitable sheet of print medium may be used, for example paper or another substrate. A sheet of print medium is used to refer to a print medium that has been cut into sheets before the printing system 1.

The print station 2 may use any suitable method to form an image on the sheet of print medium. In this example, the print station uses electrostatic principles to transfer charged particle from a metal cylinder or drum onto the print medium, forming a printed image. In some examples a plurality of sequential print stations may be provided to enable printing in color, for example using four colors such as cyan, magenta, yellow and black. In other examples, different printing technologies may be used to form a printed image on the print medium, such as inkjet, belt transfer or other configurations.

Figure 2:
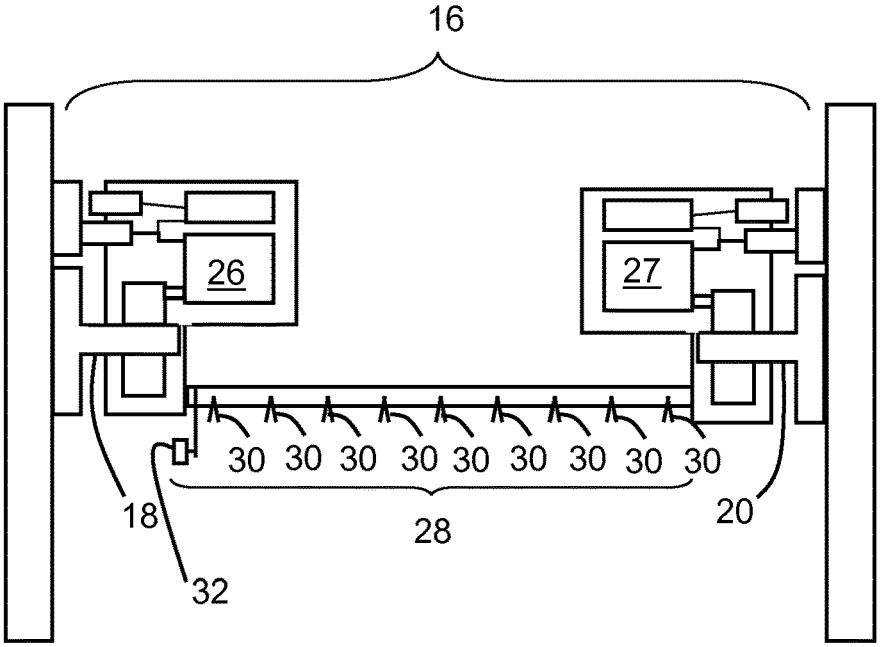
FIG. 2 is a diagrammatic representation of an example a print medium transport system.
Figure 3:
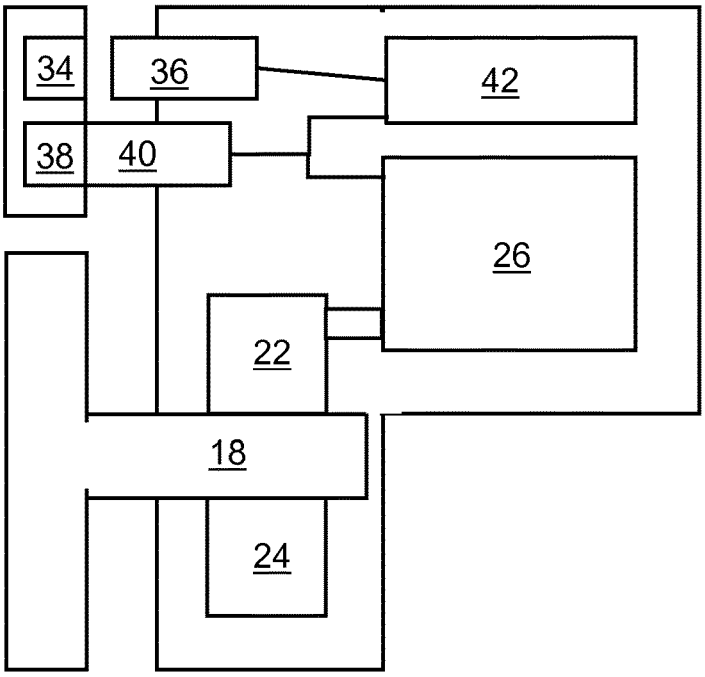
FIG. 3 is a more detailed diagrammatic representation of part of the print medium transport system of FIG. 2.

To move the print medium along the transport path, the print medium transport system comprises a transport apparatus 16, depicted in FIG. 1 as positioned at the print medium entry point 6. The construction of the print medium transport system is depicted in diagrammatic form in FIG. 2, with FIG. 3 showing more detail. Referring to FIG. 2, the transport apparatus 16 is engaged with a track. In this example, the track comprises two rails 18, 20 parallel to each other and extending towards each other. In this way the rails are positioned either side of the transport path 4, so that in use the print medium extends between the rails transverse to the transport path 4. The rails 18, 20 are positioned apart by a distance greater than the width of the sheet of print medium. The transport apparatus 16 engages the track. In this example, the rails 18, 20 are engaged by a bearing 22, 24, or a wheel, on opposing faces of the rails 18, 20. Engaging the track on more than one surface may provide more stable movement of the printing system along the track. Other examples may engage a track on a single surface.

A drive 26 is provided to move the transport apparatus 10 along the track. For example, the drive may be an electric motor, such as dc motor, stepper motor, induction motor or synchronous motor, mechanically coupled to a bearing 22 rotate the bearing 22 and move the transport apparatus along the rail 18. In other examples the drive may be integral with the bearing. Other forms of drive may be used in other examples. In one example a rack and pinion system on an additional rail (not shown) is used. In another example a magnetic propulsion system is used in which magnetic fields are generated in the drive to create a force to move the transport apparatus against a magnetic field in the rail. The magnetic field in the rail may be permanent or generated by an electromagnet.

A gripping system 28 is provided to grip the sheet of print medium while it is transported through the printing system from the print medium entry point to the print medium exit point. This may allow more reliable transport of the print medium; there are no transfers between different rollers which could result in a jam or the print medium becoming misaligned. The gripping system can be moved between a first position, in which a sheet of print medium is gripped, and a second position, in which a sheet of print medium is released. In this example, this is achieved by opening and closing gripping elements 30 in synchrony. The gripping system in this example comprises nine individual gripping elements 30 spaced evenly along the width of the print medium. Other numbers of gripping elements and different spacing may also be used in other examples. The gripping elements 30 may comprise first and second members pivotally connected to each other, which open and close to grip or release the print medium.

As the transport apparatus 16 travels along the track, the gripping elements 30 are normally biased into the first position, in which the gripper is closed. For example, a spring or other resilient biasing element may hold the first and second members together. To move the gripping elements into the second position, in which the first and second members have their ends spaced apart, allowing any gripped print medium to be released, the gripping system 28 comprises a cam follower 32 extending from it. The cam follower 32 is rotationally connected to the gripping elements 30 so that displacement of the cam follower moves the first and second members of the gripping elements away from each other and into the second position.

The printing system defines elements to engage with the cam follower 32 in the parts of the transport path where the gripping system 30 is moved to the second position. For example, the cam follower 32 may be displaced against the biasing spring to open the gripping system to the second position by engaging a cam surface adjacent the transport path. In an example, a first cam surface is provided at the print medium entry point 6 and a second cam is positioned at the print medium exit point 8, to move the print medium between the first and second positions.

As can be seen most clearly in FIG. 1, the track defines a closed transport path 4. In other words, the track defines a transport path 4 along which the transport apparatus 16 can travel on continuously in the same direction, without an end point beyond which the transport apparatus can travel no further. A closed transport path means that the transport apparatus 16 can grip a sheet of print medium at the entry point 6, move along the track from the entry point 6 to the exit point 8 while gripping the print medium, release the print medium and then return to entry point 6 by travelling in a same direction, for example a clockwise direction along the transport path 4 depicted on FIG. 1. There is therefore no need for the transport apparatus 16 to reverse direction, which may increase throughput and/or reliability. Some examples may not use a closed transport path, in which case a transport apparatus could be returned to the print medium entry point from an end point of a track by reversing a direction of travel.

A position of the transport apparatus 16 along the transport path 4 may be determined by a position encoding system. In one example, a position encoding element 34, such as a linear encoder, is provided along the length of the transport path 4. As depicted in FIGS. 2 and 3, the position encoding element may be separate from the rails 18, 20. In other examples, the position encoding elements may be integral with the rails 18, 20. The transport apparatus 16 is provided with a position sensor 36 arranged to read the position encoding element. Various different forms of position encoding element 34 and sensor 36 may be used, such as visible markings and an optical sensor, magnetic position coding and a magnetic sensor. In some examples, the position encoding element may encode an absolute position along the transport path 4, for example a defined distance from an origin. The origin may be the print medium entry point 6. In other examples, the position encoding element 34 may encode a relative position along the transport path, for example indicating a predetermined distance so that counting the number of encoding elements passed indicates a distance traveled.

In use, the transport apparatus 16 moves along the transport path through the action of the drive 26, which may be provided with electrical power from a power source. In the example of FIGS. 2 and 3, electrical power is provided through engaging an electrical contact 38, which extends at least partially along the length of the transport path, and which is engaged or contacted by a corresponding electrical contact 40 on the transport apparatus 16. This may allow electrical power to be supplied to the transport apparatus 16 in a way which reduces trailing wires. A return path for the circuit can be provided through the one or both of the rails 18, 20 or through another electrical contact extending at least partially along the length of the transport path. The electrical contact 38 need not extend completely around the length of the track, for example the transport apparatus may comprise a rechargeable power source (not shown), such as battery, which is recharged when the terminals are in contact. In other examples, the transport apparatus may be powered in other ways, such as by a direct wire connection with enough slack in the wire to allow for the transport apparatus to remain connected while it moves around the track, or by inductive coupling.

In order to control the motion of the transport apparatus 16, a controller 42 may be provided. The controller 42 receives electric power from the electrical contact 40 and is configured to receive data from the position sensor 36 and use control the drive 26 based on information from the position sensor 36.

In the example of FIG. 2, a drive 26, 27 is provided for each rail 18, 20. The construction of the other side of the transport apparatus, containing drive 27, may be the same as described above for FIG. 3. The respective drives 26, 27 may be driven together or independently. By providing a drive 26, 27 for each rail, the position of the transport apparatus 10 may be controlled more accurately, for example to ensure that a print medium gripped by the transport apparatus 10 is transported squarely through the printing system. Any difference in position along the transport path between either side of the transport apparatus 16 on the rails 18, 20 can be controlled to be reduced, so that a leading edge of a print medium is generally perpendicular to the transport direction and square to the print station 2. In other examples, a drive may be provided on one side, with the other side following and not driven. In that case, the rigidity of the transport apparatus may assist in maintaining a leading edge of a print medium generally perpendicular to a transport direction.

Figure 4:
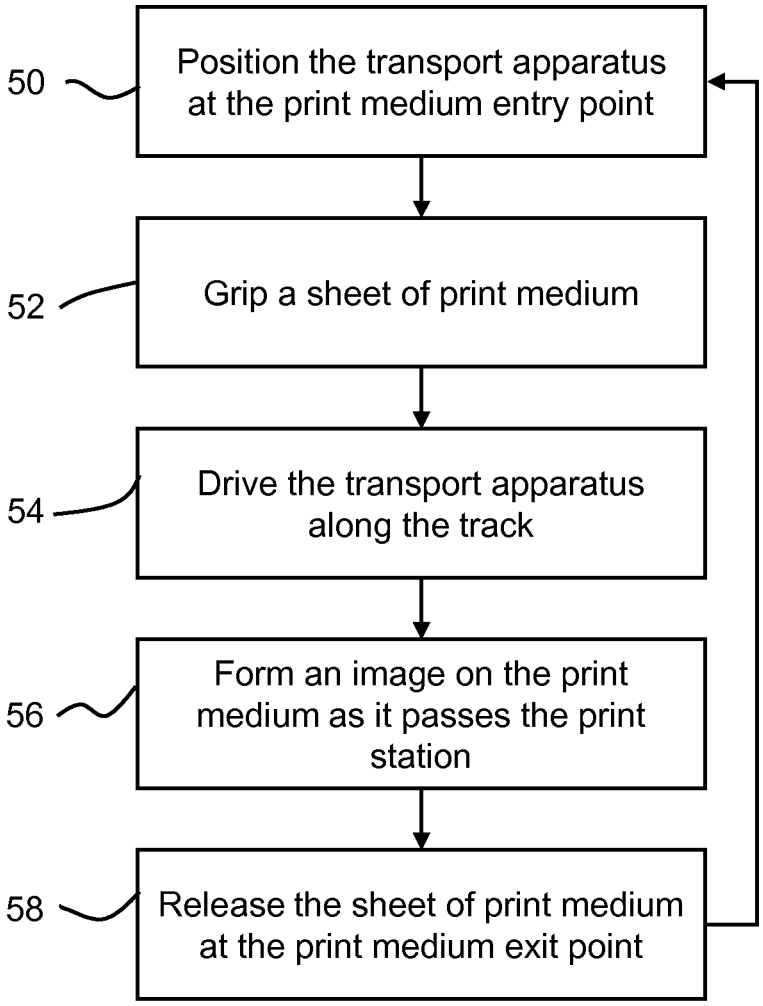
FIG. 4 is diagrammatic representation of an example method printing with the example printing system of FIG. 1.

The printing system 1 of the example of FIG. 1 can be used in a method of printing. An example method of printing is given in FIG. 4. At 50, the transport apparatus 16 is positioned at the print medium entry point 6 on the transport path 4. This can be achieved by controlling the drives 26, 27 based on measured position from the position sensor 36.

Once in position, a sheet of print medium is gripped by the transport apparatus 16 at the print medium entry point at 52. For example, the cam follower 32 may have engaged a cam surface to open the grippers 30 to the second position, enabling the grippers 30 to receive a leading edge of a sheet of print medium. Further movement of the transport apparatus causes the cam follower 32 to move off the cam surface, causing the grippers 30 to return to their closed position under the biasing action of the spring or resilient element, gripping the sheet of print medium. In another example, where the grippers are controlled by an electrical actuator, the grippers may be controlled to move between the first and second positions using a control signal.

The transport apparatus 16 is then driven along the track towards the print medium exit point while gripping the sheet of print medium at 54. The sheet of print medium may be gripped continuously during this movement. As the transport apparatus 16 moves, it pulls the sheet of print medium by its leading edge along the transport path. In the example of FIG. 1, using electrostatic printing, the print medium may be supported by the cylinder or drum, in addition to being gripped by the transport apparatus 16. Additionally or alternatively, the print medium may be supported by other elements, such as a support surface, a support element or a support roller, on its journey along the transport path. The print medium is gripped throughout travel past the print station along the transport path, improving the reliability of image formed and reducing the risk of jams.

At 56, the print station 2 is controlled to form an image on the print medium as the print medium passes the print station 2. In the example of FIG. 1, an image be formed at position 3 on the transport path. The print medium then continues to be pulled along the transport path 4 by the transport apparatus 16. When the transport apparatus 16 reaches the print medium exit point, the print medium is released. For example, a cam surface may engage a cam follower or an actuator controlled with using a control signal as described above for 52. Onward travel of the print medium may then use other elements such as a conveyor or roller. In some examples, the transport path may extend completely over an exit point so that when released by the gripping system, the print medium is released from the printing system.

Figure 5:
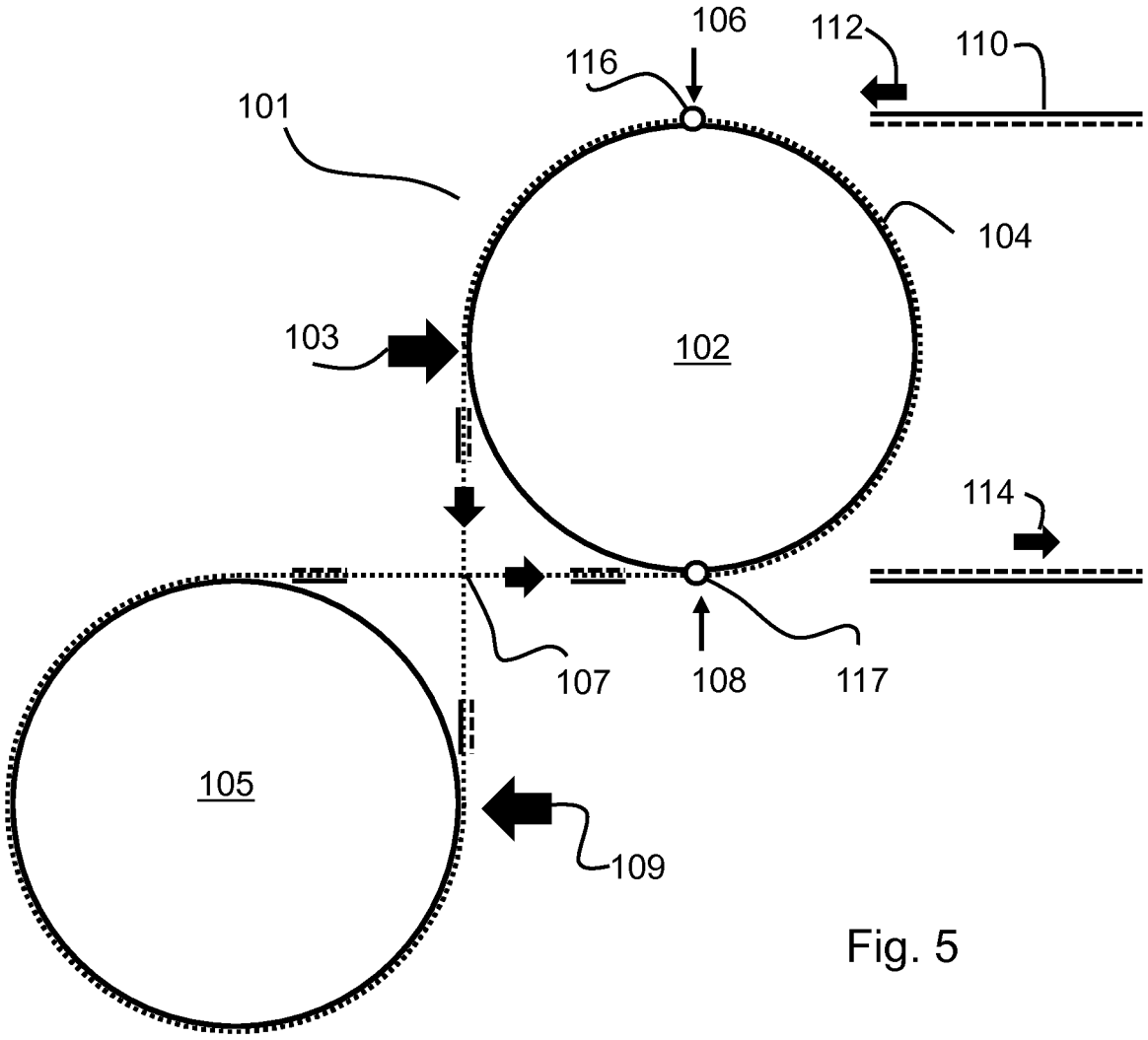
FIG. 5 is a diagrammatic representation of a printing system according to another example.

Another example printing system is depicted in FIG. 5. FIG. 5 shows a diagrammatic representation of a printing system 101 which comprises a first print station 102, a second print station 105 and print medium transport system defining a transport path 104. The transport path 104 is a closed transport path and includes a crossover point 107. A crossover point in the transfer path allows the print medium to be turned over during transport, for example so that printing on both sides is possible.

In this example, the transport path 104 also includes two loops, one either side of the crossover point 107, so that the crossover point is between the two loops. Transport path 104 may be substantially in the form of a figure-of-eight. In other examples the transport path may include more than one crossover point and fewer or more loops than two.

The transport path 104 is adjacent to both the first print station 102 and the second print station 105. The use of the cross over point 107 and the enables a different side of the print medium 110 to be presented to the first print station 102 than is presented to the second print station 105. This can allow printing on both sides of the print medium automatically. FIG. 5 illustrates on side of the print medium 110 with a solid line and the other, reverse side of the print medium 110 with a dashed line. The orientation of the print medium with respect to the print stations 102, 105 at various points along the transport path 104 is depicted in FIG. 5.

The transport apparatus 116 grips the print medium while transporting the print medium from a print medium entry point 106 in a direction 112 to the print medium exit point 108 when the print medium exits the printing system in the direction 114. During movement along the transport path 106, the print medium 110 is gripped by a transport apparatus 106. The transport apparatus 106 and related elements of the print medium transport station may be the same as described with reference to FIGS. 2 and 3 above. There is no need to transfer the print medium from one element to another so there is less risk of jam. The registration of the printed image on both sides is also improved; the print medium can be maintained square with both the first print engine and the second print engine. In printing systems where print medium is transported by multiple rollers, inaccuracies in registration can occur form the print medium becoming skewed during transfer between rollers, for example because of inaccurate cutting of the print medium.

The example of FIG. 5 also includes a second transport apparatus 117, which may have the same construction as the transport apparatus 116. The second transport apparatus 117 is configured to move along the transport path 104 maintaining a predetermined from the transport apparatus 116. A second transport apparatus 117 enables the throughput to be increase because more than one sheet of print medium is in transport through the printing system at any one time.

The predetermined distance may be chosen as longer than a sheet of print medium, to ensure that the second print apparatus 117 does not contact any print medium gripped by the transport apparatus 116. The actual distance between the second transport apparatus 117 and the transport apparatus 116 may be fixed, for example the transport apparatus and second transport apparatus may move along the transport path 104 in synchrony or in lockstep. The actual distance between the print transport apparatus 116 and second print transport apparatus 117 may also vary, for example to accommodate differing lengths of print medium. For example, by controlling the second print transport apparatus 117 to be further from the print transport apparatus 116, longer sheets of print medium can be used. With a print medium which is longer than half the length of the transport path 104, it may be possible to have a single sheet of print medium in the printing system at one time. In such cases, second print apparatus may be positioned just ahead of the transport apparatus and driven round the track without gripping print medium.

Figure 6:
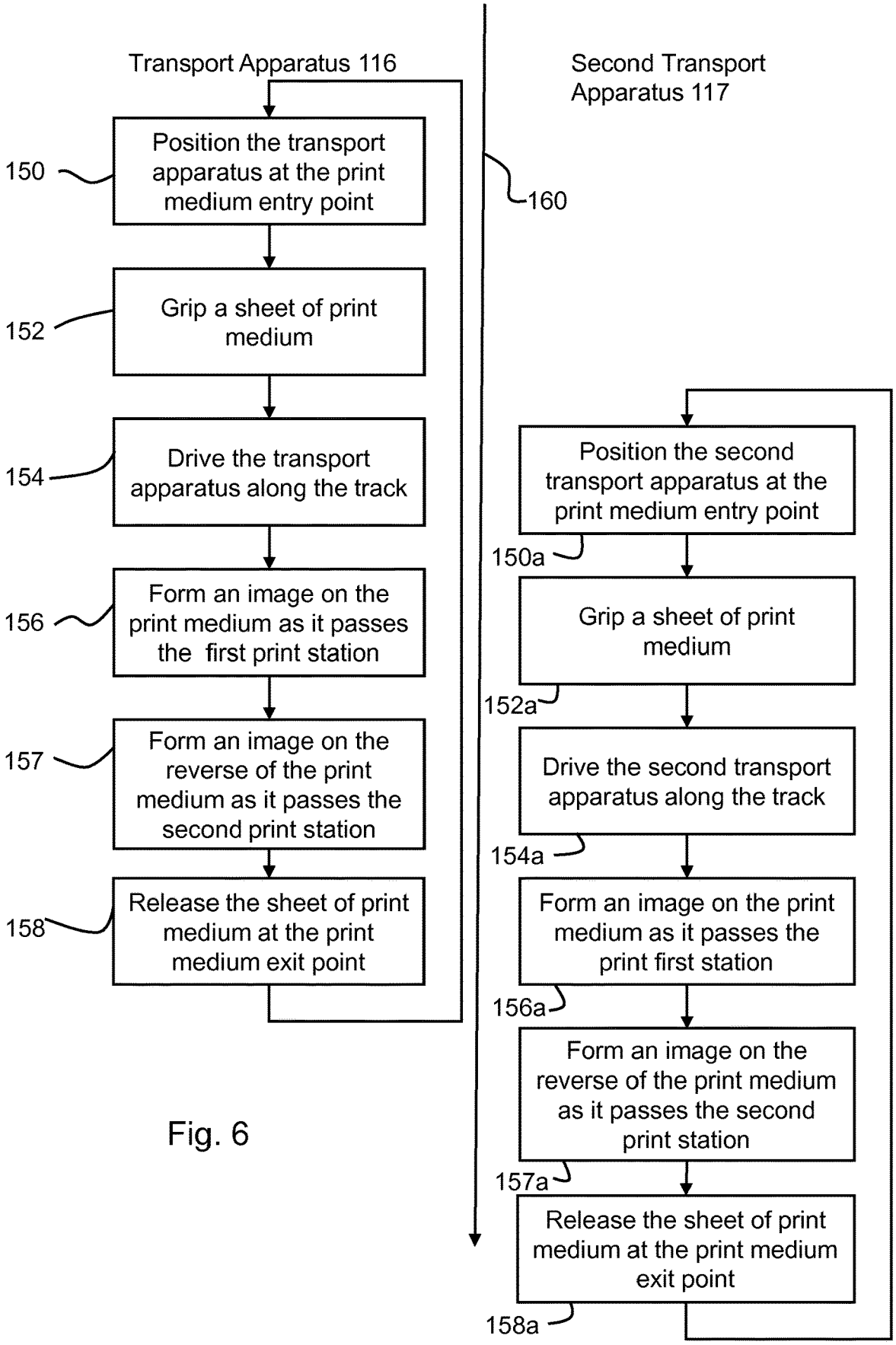
FIG. 6 is diagrammatic representation of an example method printing with the example printing system of FIG. 5.

FIG. 6 depicts a flow chart of the printing operation of the example printing system of FIG. 5. First, with reference to the left hand side of FIG. 6, the method of printing using the transport apparatus 116 will be described. At 150, the transport apparatus 116 is positioned at the print medium entry point 106 on the transport path 104. This can be achieved in same way as discussed above with reference to element 50 of FIG. 4.

Once in position, at 152 a sheet of print medium is gripped by the transport apparatus 116 at the print medium entry point 104. This can be achieved in same way as discussed above with reference to element 52 of FIG. 4.

The transport apparatus 16 is then driven along the track towards the print medium exit point while gripping the sheet of print medium at 154. This can be achieved in same way as discussed above with reference to element 54 of FIG. 4.

At 156, the print station 102 is controlled to form an image on the print medium as the print medium passes the print station 102. In the example of FIG. 5, an image is formed at position 103 on the transport path. At 157, the second print station 105 is controlled to form an image on the reverse side of the print medium as the print medium passes the second print station 105. In the example of FIG. 5, an image is formed on the reverse side at position 109 on the transport path. The print medium then continues to be pulled along the transport path 104 by the transport apparatus 116. When the transport apparatus 16 reaches the print medium exit point 108 at 158, the print medium is released. For example, a cam surface may engage a cam follower or an actuator controlled with using a control signal as described above for 52 of the method of FIG. 4. Onward travel of the print medium may then use other elements such as a conveyor or roller. In some examples, the transport path may extend completely over an exit point so that when released by the gripping system, the print medium is released from the printing system.

The example method of FIG. 6 allows both sides of a print medium to be printed automatically. The print medium is gripped throughout travel past the first and second print stations along the transport path which may improve the reliability of image formed, reduce the risk of jams and or improve image registration between the forward and reverse sides of the print medium.

The right hand side of FIG. 6 also show in diagrammatic form how a method of printing using the second transport apparatus 117 can take place simultaneously with using the transport apparatus 116. The method of printing using the second transport apparatus 117 comprises elements 150*a*, 152*a*, 154*a*, 156*a*, 157*a*, 158*a* which are the same as elements 150, 152, 154, 156, 157, 158 respectively, except that they use the second transport apparatus 117. The second apparatus 117 can carry out operations in parallel with the transport apparatus 116 to increase throughput. By considering the vertical axis 160 of FIG. 6 to be time, FIG. 6 shows diagrammatically how the printing method of the second transport apparatus 117 is offset in time from the printing method of the transport apparatus 116. The elements of FIG. 6 are not all necessarily equal in time; FIG. 6 is illustrative of the parallel nature of the processes.

Figure 7:
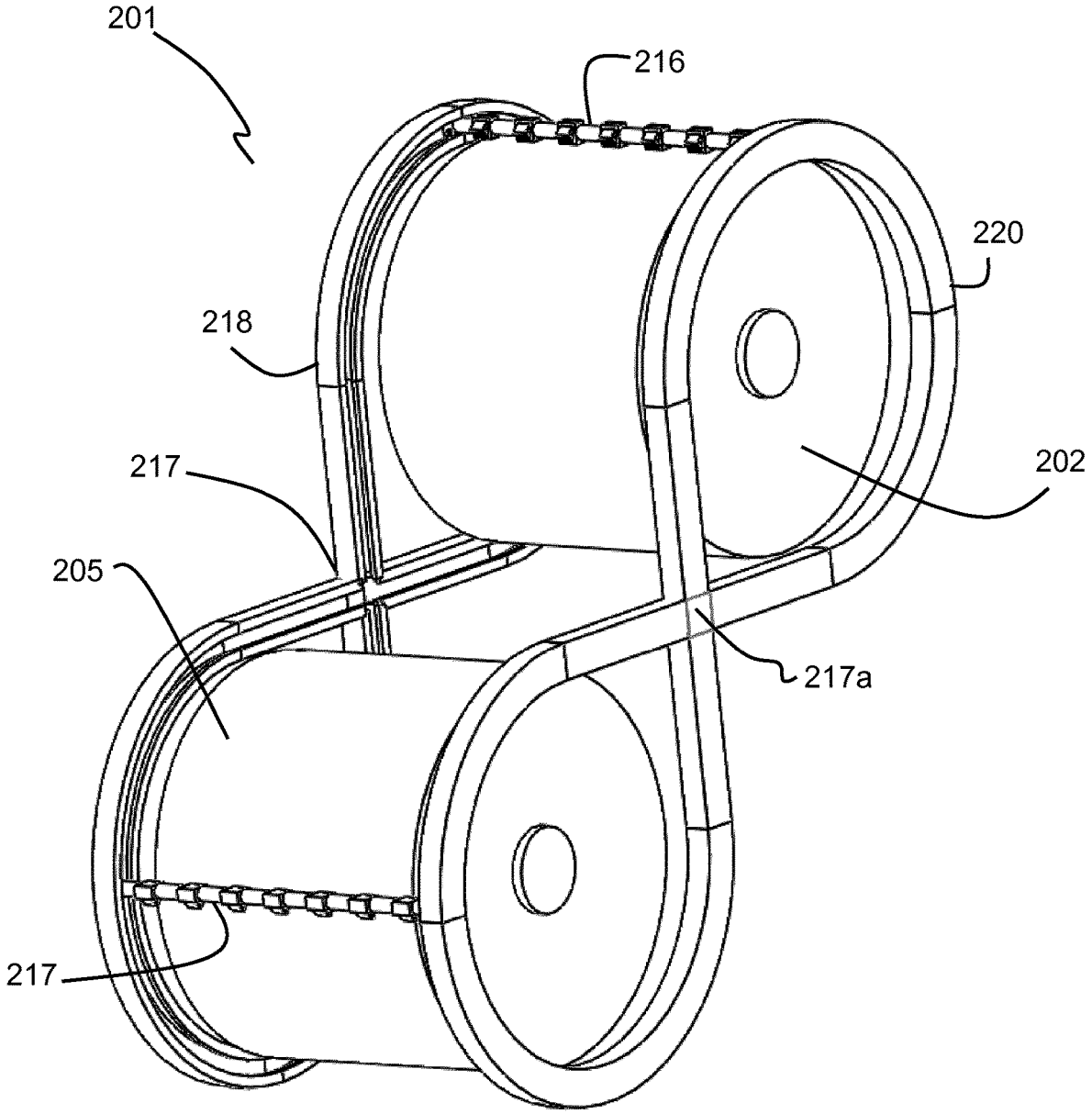
FIG. 7 is a diagrammatic representation of a printing system according to a further example.

Another example printing system is depicted in FIG. 7. FIG. 7 depicts a three-dimensional diagrammatic representation of printing system 201. The printing system 201 includes first print engine 202 and a second print engine 205. A print medium transport system comprises two opposed tracks, 218, 220 which define a transport path having a crossover point 217, 217*a* and two loops in a similar way to the example of FIG. 5.

Figure 8:
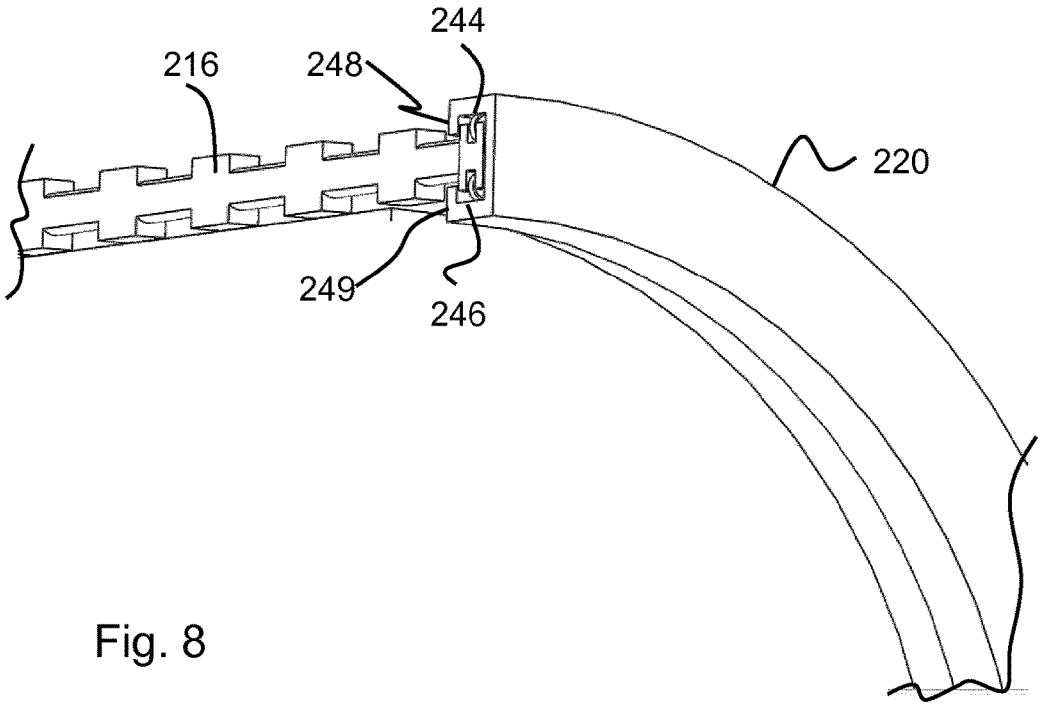
FIG. 8 is a diagrammatic representation of a cut away view of the printing system of FIG. 7.

The tracks 218, 220 define a recess along their length, in the direction along the track. FIG. 8 depicts a cut away view of the printing system of FIG. 7, around the transport apparatus 216, showing the recess in more detail. A least a part of the transport apparatus 216 is engaged with the recess. Engaging the recess in this way, so that a part of the transport apparatus 216 is contained within a recess of the track 220 may provide a more stable motion of the transport apparatus as it moves along the track 220. The recess has a first side wall 244 and a second side wall 246, wherein the first side wall 244 and second side wall 246 are substantially parallel to each other and to the direction along the track. The first side wall 244 and the second side wall 246 are also substantially parallel to the sheet of print medium when it is being transported. Lips 248, 249 extend from the first and second side walls 244,246 to partially encapsulate the transport apparatus 216 within the recess of the track 220.

Figure 9:
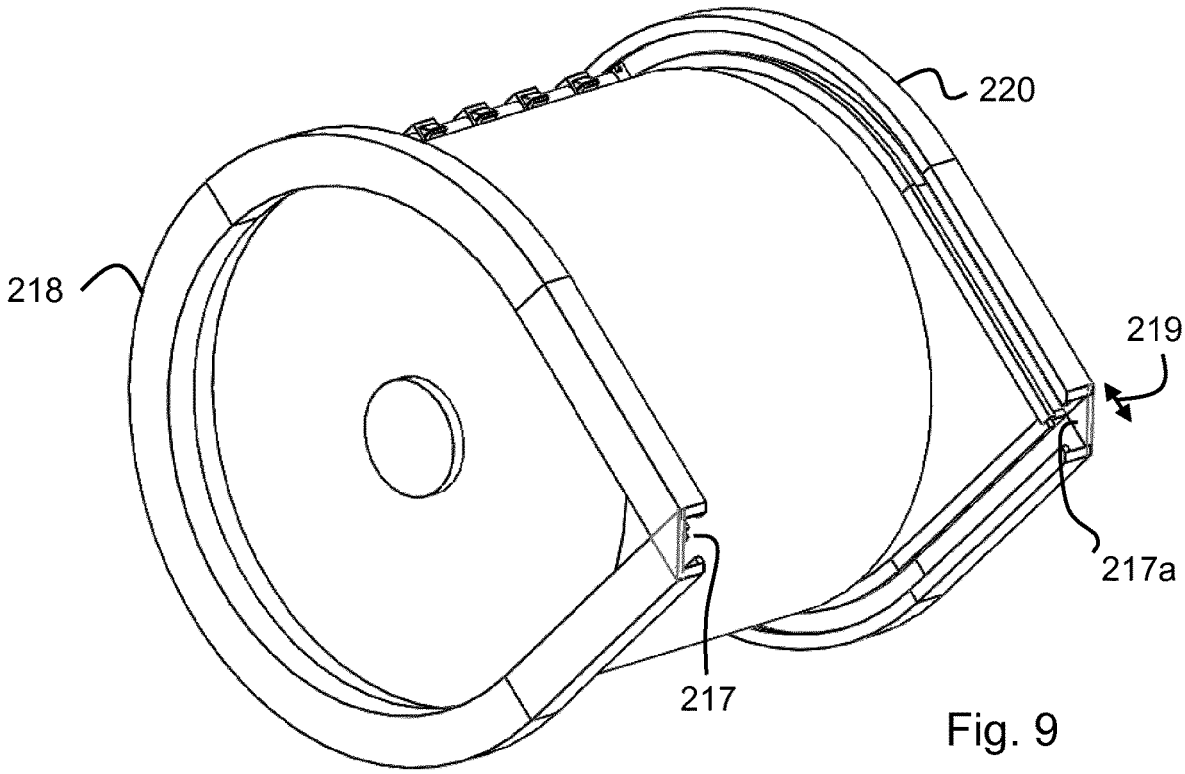
FIG. 9 is a diagrammatic representation of another cut away view of the printing system of FIG. 7.

FIG. 9 depicts a cut away view of cross over portion 217, 217*a* of the track 218, 220 of FIG. 7. The use of a track defining a recess in the example of FIG. 7 means that there is a discontinuity or gap in the side walls of the recess at the cross over point 217, 217*a*. To ensure that the transport apparatus 216 remains engaged with the track, the part of the transport apparatus 216 contained within the recess has a dimension in a direction along the track which is greater than a length 219 of the discontinuity in the side walls at the cross over point 217, 217*a*.

Referring again to FIG. 7, this example also comprises a second transport apparatus 217 engaged with the tracks 218, 220. A second transport apparatus can allow two sheets of print medium to be processed by the printing system at that the same time, increasing throughput. For example, a first sheet of print medium may be transported past the first print station 202, with the first print station 202 being controlled to print on a first side of the first print medium. Then, as the first sheet of print medium progresses along the transport path to the second print station 205, the second transport apparatus 217 may grip a second sheet of print medium and begin transporting it to the first print station 202. The second sheet of print medium may then be printed by the first print station 202 at substantially the same time as the first sheet of print medium is printed by the second print station 205.

Where there are two transport apparatus 216, 217, the second transport apparatus 217 may be configured to maintain a predetermined distance from the other transport apparatus along the track. The predetermined distance may be at least the length of a sheet of print medium and may take into account, for example, the possibility of the second transport apparatus colliding with the other transport apparatus or colliding of a print medium gripped by the other transport apparatus at any point on the transport path, including the crossover point.

In other examples, more than two transport apparatus can be provided. For example there may be the same number of transport apparatus as there are printing stations.

In the example of FIG. 7, the gripping system comprises an actuator to move the gripping system between the first and second positions. This may allow a more compact and simple construction of the track. The actuator may be powered electrical power and moved between the first and second positions based on the position of the transport apparatus along the track. The cam system described earlier with reference to FIGS. 2 and 3 may also be used with example of FIG. 7, replacing the actuator. Likewise, the actuator system of FIG. 7 may be used in place of the cam system of FIG. 2.

Certain system components and methods described herein may be implemented by way of non-transitory computer program code that is storable on a non-transitory storage medium. In some examples, a print controller may comprise a non-transitory computer readable storage medium comprising a set of computer-readable instructions stored thereon. The print controller may further comprise one or more processors. In some examples, control may be split or distributed between two or more controllers which implement all or parts of the methods described herein. For example, when there are two or more transport apparatus, each transport apparatus may have its own controller.

Figure 10:
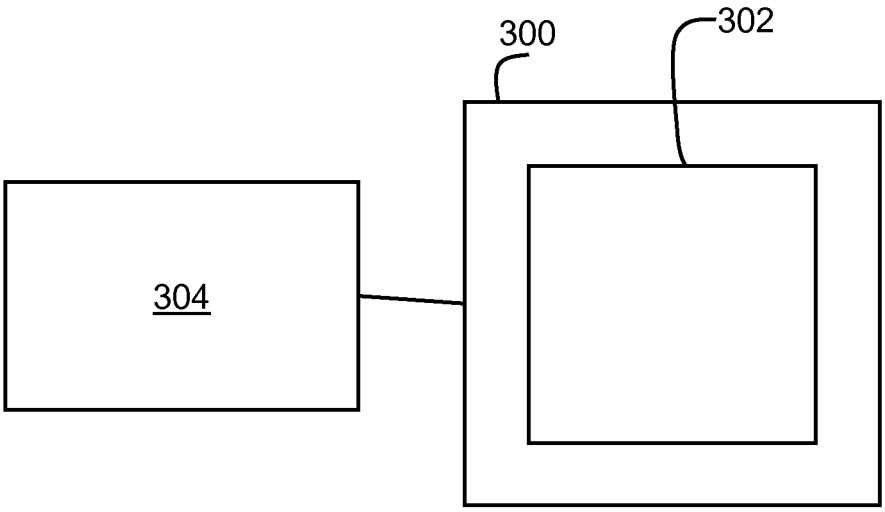
FIG. 10 shows an example of a non-transitory computer-readable storage medium.

FIG. 10 shows an example of such a non-transitory computer-readable storage medium 300 comprising a set of computer readable instructions 302 which, when executed by at least one processor 304, cause the processor(s) 304 to perform a method according to examples described herein. The computer readable instructions 300 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

What is claimed is:

1. A printing system comprising:

a first print station; and a print medium transport system comprising:

a track defining a transport path past the first print station, wherein two opposed tracks define the transport path having a crossover point and two separate loops, and the transport path has a print medium entry point and a print medium exit point; and a transport apparatus engaged with the track, wherein the transport apparatus comprises:

a drive to move the transport apparatus along the track; and a gripping system movable between a first position in which a sheet of print medium is gripped and a second position in which the sheet of print medium is released;

wherein, in use, the gripping system is configured to be in the first position when the transport apparatus is in motion along the track from the print medium entry point to the print medium exit point, and wherein:

the print medium transport system comprises a position encoding element along a length of the transport path; and the transport apparatus comprises a sensor to sense the position encoding element.

2. A printing system according to claim 1, wherein the track defines a closed transport path.

3. A printing system according to claim 1, wherein the track defines the transport path with the crossover point.

4. A printing system according to claim 3, wherein the track defines the transport path including the two loops, and wherein the crossover point is between the two loops.

5. A printing system according to claim 4, comprising:

a second print station; and wherein the track defines the transport path in which the first print station is located adjacent to a first loop of the two loops and the second print station is located adjacent to a second loop of the two loops.

6. A printing system according to claim 3, wherein the track defines a recess along its length and at least a part of the transport apparatus is contained within the recess.

7. A printing system according to claim 6, wherein the part of transport apparatus contained within the recess has a dimension in a direction of travel which is greater than a dimension of the crossover point in the direction of travel.

8. A printing system according to claim 1, wherein the print medium transport system comprises a second transport apparatus engaged with the track, the second transport apparatus configured to maintain a predetermined distance from the transport apparatus along the track.

9. A printing system according to claim 1, wherein the print medium transport system comprises:

a first electrical contact at least partially along a length of the track; and an electrical power source connected to the electrical contact, wherein the transport apparatus comprises a second electrical contact engaged with the first electrical contact.

10. A printing system according to claim 1, wherein:

the gripping system comprises a cam follower; and the track comprises a first cam at the print medium entry point and a second cam at the print medium exit point, the first cam and the second cam positioned at the print medium entry point and the print medium exit point to move the gripping system between the first position and the second position.

11. A printing system according to claim 1, wherein the gripping system comprises an actuator operable to move the gripping system between the first position and the second position.

12. A printing system comprising a first print station;

a second print station; and a print medium transport system comprising:

a track defining a transport path for a sheet of print medium past the first print station and the second print station, wherein two opposed tracks define the transport path having a crossover point and two separate loops, and the transport path has a print medium entry point and a print medium exit point, and the transport path is configured to present a first side of the sheet of print medium to the first print station and to present a second side of the sheet of sheet of print medium to the second print station; and a transport apparatus engaged with the track, wherein the transport apparatus comprises:

a drive to move the transport apparatus along the track; and a gripping system movable between a first position in which a sheet of print medium is gripped and a second position in which the sheet of print medium is released;

wherein, in use, the gripping system is configured to be in the first position when the transport apparatus is in motion along the track from the print medium entry point to the print medium exit point, and wherein:

a position encoding element is disposed along the length of the transport path; and the transport apparatus comprises a sensor to sense the position encoding element.

13. A method of printing using a transport apparatus engaged with a track that defines a transport path, wherein two opposed tracks define the transport path having a crossover point and two separate loops, and the transport path extends past a print station, and wherein the transport path has a print medium entry point and a print medium exit point, the method comprising:

positioning the transport apparatus at the print medium entry point;

gripping a sheet of print medium by the transport apparatus at the print medium entry point;

driving the transport apparatus along the track towards the print medium exit point while gripping the sheet of print medium;

controlling a print station to form an image on the sheet of print medium as the sheet of print medium passes by the print station; and releasing the sheet of print medium by the transport apparatus at the print medium exit point, wherein:

the transport apparatus includes a position encoding element along a length of the transport path; and a sensor for sensing the position encoding element.

14. A method of printing according to claim 13, wherein a second transport apparatus is engaged with the track, the method comprising:

providing a second sheet of print medium at the print medium entry point while the transport apparatus is in motion towards the print medium exit point;

gripping the second sheet of print medium by the second print medium transport apparatus at the print medium entry point;

driving the second transport apparatus along the track towards the print medium exit point while gripping the sheet of print medium and maintaining a predetermined distance from the transport apparatus;

controlling the print station to form an image on the second sheet of print medium as the second sheet of print medium passes by the print station; and releasing the second sheet of print medium by the second transport apparatus at the print medium exit point.

* * * * *